US009930439B2

(12) United States Patent
Nisse et al.

(10) Patent No.: US 9,930,439 B2
(45) Date of Patent: Mar. 27, 2018

(54) HEADPHONE

(71) Applicant: Sennheiser electronic GmbH & Co. KG, Wedemark (DE)

(72) Inventors: Olav Nisse, Hildesheim (DE); Alexander Grimm, Wunstorf (DE); Kornelia Kaddig, Wietze (DE); Christoph Weinreuter, Hannover (DE); Mirko Hausen, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/107,520

(22) PCT Filed: Dec. 10, 2014

(86) PCT No.: PCT/EP2014/077279

§ 371 (c)(1),
(2) Date: Jun. 23, 2016

(87) PCT Pub. No.: WO2015/096987

PCT Pub. Date: Jul. 2, 2015

(65) Prior Publication Data

US 2016/0323663 A1 Nov. 3, 2016

(30) Foreign Application Priority Data

Dec. 23, 2013 (DE) ..... 10 2013 227 088

(51) Int. Cl.
*H04R 25/00* (2006.01)
*H04R 1/10* (2006.01)
*H04R 5/033* (2006.01)

(52) U.S. Cl.
CPC ..... *H04R 1/1041* (2013.01); *H04R 1/1008* (2013.01); *H04R 1/1066* (2013.01);
(Continued)

(58) Field of Classification Search
CPC .. H04R 1/1041; H04R 1/1008; H04R 1/1066; H04R 5/0335; H04R 2201/025; H04R 2460/17
(Continued)

(56) References Cited

U.S. PATENT DOCUMENTS 3,796,841 A 3/1974 Gorman
2004/0213428 A1* 10/2004 Lenhard-Backhaus H04R 1/1066 381/370
(Continued)

FOREIGN PATENT DOCUMENTS

DE 3332496 3/1985
EP 1 443 799 8/2004
(Continued)

OTHER PUBLICATIONS

International Search Report and a Written Opinion for Application No. PCT/EP2014/077279 dated Feb. 18, 2015.

*Primary Examiner* — Sean H Nguyen
(74) *Attorney, Agent, or Firm* — Haug Partners LLP

(57) ABSTRACT

There is provided a headphone having an over-the-head headband which is of an arcuate configuration and spans a central plane. The headphone has at least one spacer element which is fixedly connected to an end of the over-the-head headband and projects out of the central plane, at least one articulation which is fixed to the spacer element at a spacing relative to the central plane and at least one ear cap which is coupled pivotably by way of the at least one articulation to the spacer element. The articulation is so provided that its pivot axis is substantially perpendicular to the surface of the head of a user of the headphone so that the ear cap can be pivoted by means of the articulation from a first position in which it covers an ear of the user into a second position in which the ear is exposed.

8 Claims, 2 Drawing Sheets

(52) U.S. Cl.
CPC ..... *H04R 5/0335* (2013.01); *H04R 2201/025* (2013.01); *H04R 2460/17* (2013.01)

(58) Field of Classification Search
USPC ..... 381/379
See application file for complete search history.

(56) References Cited

U.S. PATENT DOCUMENTS

| | | | | |
|---|---|---|---|---|
| 2007/0258614 | A1 | 11/2007 | Langberg | |
| 2011/0206216 | A1 | 8/2011 | Brunner et al. | |
| 2013/0156248 | A1* | 6/2013 | Nakajima ..... | H04R 1/1091 381/374 |

FOREIGN PATENT DOCUMENTS

| | | |
|---|---|---|
| EP | 1 479 261 | 11/2004 |
| EP | 1 622 419 | 2/2006 |
| EP | 1 638 364 | 3/2006 |
| WO | WO 2006/089250 | 8/2006 |

* cited by examiner

HEADPHONE

The present application claims priority from International Patent Application No. PCT/EP2014/077279 filed on Dec. 10, 2014, which claims priority from German Patent Application No. 10 2013 227 088.7 filed on Dec. 23, 2013, the disclosures of which are incorporated herein by reference in their entirety.

FIELD OF THE INVENTION

It is noted that citation or identification of any document in this application is not an admission that such document is available as prior art to the present invention.

The present invention concerns a headphone.

EP 1 479 261 B1 discloses a headphone having a headband hoop, at the two ends of which is fixed a respective acoustic transducer. The hoop extends in an arcuate configuration in a plane and has at least one pivot for folding in the hoop ends in the plane.

The headphone HD 25 from Sennheiser electronic GmbH & Co KG has been on sale since 6/89 and has a headband which is of an arcuate configuration and which spans a plane, and at the two ends of the headband a respective pivot axis for pivoting the ear cap or the housings of the acoustic reproduction transducers. In that arrangement the rotary or pivot axis is disposed in the plane spanned by the headband.

In the German patent application from which priority is claimed the German Patent and Trade Mark Office searched the following documents: US 2011/0206216 A1; US 2007/0258614 A1; WO 2006/089250 A2; EP 1 443 799 A2 and EP 1 479 261 B1.

SUMMARY OF THE INVENTION

An object of the present invention is to provide a headphone having an over-the-head headband and a device for exposing an ear, that even with the ear exposed sits securely on the head.

Thus there is provided a headphone having an over-the-head headband which is of an arcuate configuration and spans a central plane, at least one spacer element which is fixedly connected to an end of the over-the-head headband and projects out of the central plane, at least one articulation which is fixed to the spacer element at a spacing relative to the central plane and at least one ear cap which is coupled pivotably by way of the at least one articulation to the spacer element. The articulation is so provided that its pivot axis is substantially perpendicular to the surface of the head of a user of the headphone so that the ear cap can be pivoted by means of the articulation from a first position in which it covers an ear of the user into a second position in which the ear is exposed. The ear cap has a central region which in the first position lies substantially in the central plane so that a connecting line between the articulation and the central region in the first position is inclined relative to the central plane spanned by the headband.

According to an aspect of the present invention the ear cap is connected to the articulation by way of a connecting portion.

According to a further aspect of the present invention the spacing of the articulation from the central plane is so selected that the central region of the ear cap in the second position comes to lie substantially at the same height on the head of a user as in the first position.

According to a further aspect of the present invention the spacing between the pivot axis of the articulation and the central plane is in a range of between 10 and 50 mm.

According to a further aspect of the present invention the pivot axis of the articulation is substantially parallel to the central plane.

According to a further aspect of the present invention the headphone is of a substantially symmetrical structure so that at both ends of the over-the-head headband a respective ear cap is fixed pivotably to the over-the-head headband by means of an articulation spaced from the central plane.

According to a further aspect of the present invention each of the two ear caps has a jack for receiving a plug of a connecting cable.

According to a further aspect of the present invention the two articulations are so designed that the two ear caps for transport of the headphone can be so pivoted that they are at least partially surrounded by the over-the-head headband.

The invention concerns a headphone having an over-the-head headband, wherein the over-the-head headband is of a C-shaped or U-shaped configuration and spans a plane. An articulation having a pivot axis is provided at least one end of the headband. The articulation is so arranged that its pivot axis is substantially perpendicular to the surface of the head of a user of the headphone. The pivot axis is arranged displaced relative to the plane spanned by the headband, that is to say there is a spacing between the pivot axis and the plane. A connecting portion which carries an ear cap or a housing for a reproduction transducer is provided at the articulation in such a way that the housing can be pivoted by way of the pivot axis. Thus the ear cap or the housing for the electroacoustic transducer can be pivoted from a first operating position into at least one second operating position. In that respect the first operating position represents the position in which the ear cap is placed or arranged over the ear of a user. In the second operating position the ear cap, when the headphone is being worn, can be pivoted rearwardly so that an ear remains free and the pivoted ear cap bears against the head. Optionally both ends of the headband can be equipped with an articulation of the kind described. Then the user of the headphone can selectively expose the left ear or the right ear.

Optionally the articulation can be so designed that the ear cap or the housing for the electroacoustic transducer is pivotable into a third operating position in which the ear cap is at least partially enclosed by the headband. That is appropriate in particular when both ends of the headband are equipped with an articulation of the kind described. When then both ear caps are pivoted into their third operating position that third operating position in that case can represent the position in which the headphone can be stowed or transported.

By virtue of the design configuration of the headphone according to the invention and in particular due to the special arrangement of the one or both pivot axes outside the plane spanned by the headband, the headphone in the fitted condition retains a secure fit on the head, even if one of the ear caps is pivoted into the second operating position.

By virtue of the headphone according to the invention the connecting portion between the articulation and the ear cap can be so arranged in the first operating position that the connection between the articulation and the center of the ear cap is inclined relative to the plane spanned by the headband. A pivotal movement of the ear cap into the second operating position provides that the ear cap can remain on the head at the same height so that it is possible to permit a horizontal or symmetrical flow of force between the two ear caps at the ends of the headband.

The headphone according to the invention can be used for example as a DJ headphone. The user can use the headphone in such a way that one of the ear caps is folded rearwardly so that one of his ears is exposed. In that way the DJ can perceive the mood and the music program at the event venue with one ear.

The invention also concerns a headset having the above-described features.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
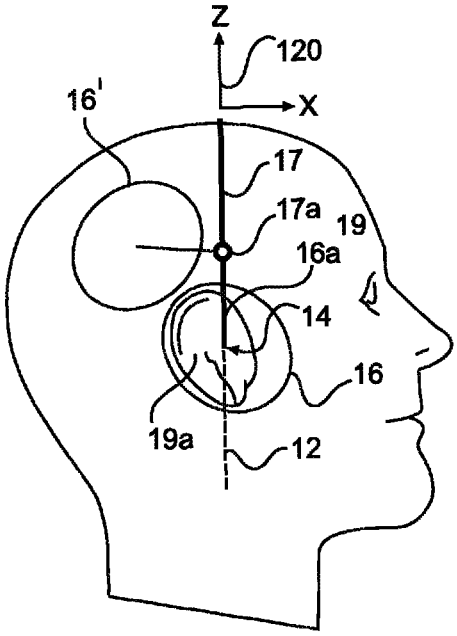
FIGS. 1A and 1B each show a diagrammatic view of a headphone according to the state of the art, FIGS. 2A and 2B each show a diagrammatic view of a headphone according to a first embodiment, and FIGS. 3A and 3B each show a view of a headphone according to a second embodiment.
Figure 1B:
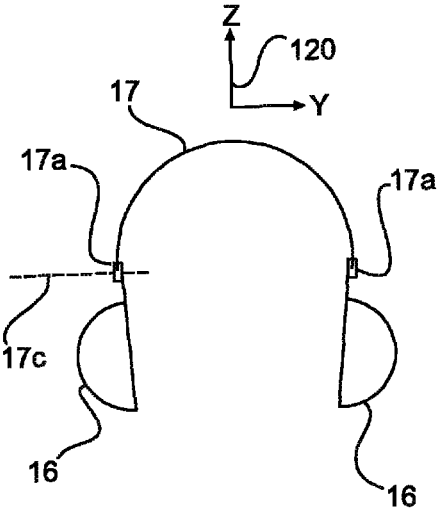

FIG. 1A shows a diagrammatic view of a headphone according to the state of the art from the side and FIG. 1B shows the same headphone as a front view. The headphone has an over-the-head headband 17 with an articulation 17*a*, a connecting portion 16*a* and an ear cap 16. The articulation 17*a* is fixed to an end of the over-the-head headband 17 and the ear cap 16 is connected to the articulation 17*a* by way of the connecting portion 16*a*. The ear cap 16 has a central region 14. The headband 17 is of an arcuate configuration and thus spans a plane or a central plane 12. The x/y/z coordinate system 120 in FIGS. 1A and 1B, the x-coordinate of which is shown in the viewing direction of the user 19, serves to identify the central plane 12. The central plane 12 spanned by the headband forms the y/z plane of the coordinate system 120. The articulation 17*a* is disposed in the central plane 12 of the headband. The pivot axis 17*c* of the articulation 17*a* is substantially perpendicular to the surface of the head of a user 19 and is thus substantially in the central plane 12 of the headband. In FIG. 1A the ear cap 16 is shown in a first wearing position and additionally in a second wearing position 16'. In the first position the ear cap 16 is so arranged that it covers the ear 19*a* of the user 19. In that first position the central region 14 of the ear cap 16 is substantially in the central plane 12. Consequently, in this first position, the connection between the articulation 17*a* and the central region 14 is also in the central plane 12 of the headband. In the second position the ear cap 16' is in a rearwardly pivoted condition so that the ear 19*a* remains free. In the case of the headphone in accordance with the state of the art as shown in FIG. 1A it can be clearly seen that the ear cap comes to lies considerably higher on the head of the user 19 in the position 16' than in the position 16. This means that the distribution of force which in the first wearing position ensures a good fit for the headphone on the head is greatly altered in the second wearing position 16'. In accordance with the state of the art therefore the fit of the headphone on the head is markedly worsened by pivoting the ear cap.

Figure 2A:
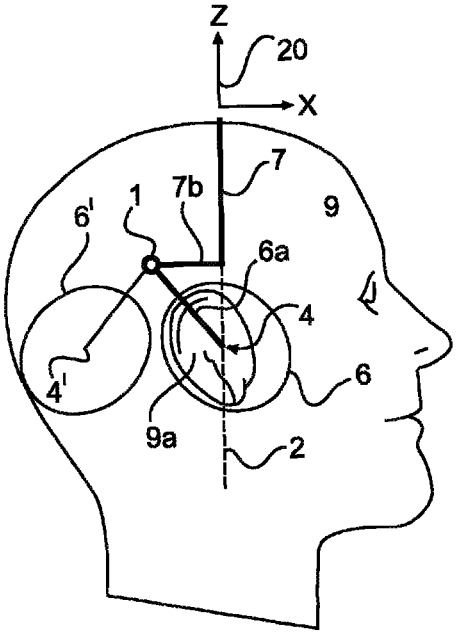
Figure 2B:
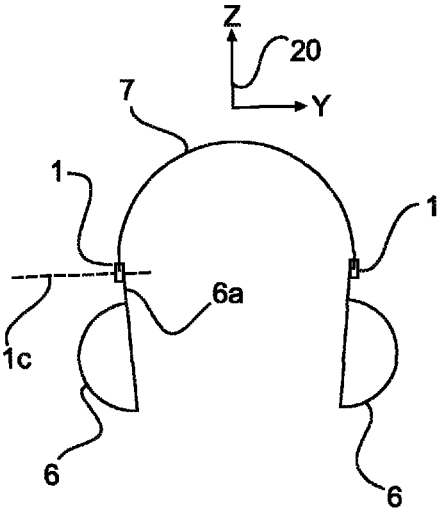

FIG. 2A shows a diagrammatic view of a headphone according to a first embodiment on a head 9 of a user from the side and FIG. 2B shows a front view of the same headphone. The headphone has an over-the-head headband 7, a spacer element 7*b* connected fixedly to the headband 7, an articulation 1, a connecting portion 6*a* and an ear cap 6. The spacer element 7*b* is fixedly secured with an end to the over-the-head headband 7 and carries the articulation 1 at its other end. The ear cap 6 is connected to the articulation 1 by way of the connecting portion 6*a*. The ear cap 6 has a central region 4. The headband 7 is of an arcuate configuration and thus spans a plane or a central plane 2. The x/y/z coordinate system 20 in FIGS. 2A and 2B, whose x-coordinate is shown in the direction of view of the user 9, serves to identify the central plane 2. The central plane 2 spanned by the headband forms the y/z plane of the coordinate system 20.

In contrast to the state of the art in FIGS. 1A/B the articulation 1 in the first embodiment is arranged spaced from the central plane 2 of the headband by means of the spacer element 7*b*. The pivot axis 1*c* of the articulation 1 is substantially perpendicular to the surface of the head of a user 9 and in the first embodiment is thus substantially parallel to the central plane 2 of the headband but is at a spacing relative to the central plane 2, that is predetermined by the spacer element 7*b*.

FIG. 2A shows the ear cap 6 in a first wearing position and additionally in a second wearing position 6'. In the first position the ear cap 6 is so arranged that it covers the ear 9*a* of the user. That first position 6 is the normal position in which the headphone is used when listening with both ears. In that first position the central region 4 of the ear cap 6 is disposed substantially in the central plane 2, which provides for a comfortable secure fit for the headphone in the normal position. As the articulation 1 is not in the central plane 2 the connection 6*a* between the articulation 1 and the central region 4 is inclined with respect to the central plane 2 spanned by the headband.

In the second wearing position the ear cap 6' is in a rearwardly pivoted condition so that the ear 9*a* remains free and the ear cap 6' bears against the back part of the head of the user. According to the invention the spacing of the articulation 1 from the central plane 2, provided by the spacer element 7*b*, can be so selected that, in the pivotal movement from the first position into the second position, the connection 6*a* between the articulation 1 and the central region 4 can be pivoted beyond a position parallel to the central plane 2 and thus the central region 4' of the ear cap, in the second wearing position on the head, comes to lie substantially at the same height of the central point 4 in the first wearing position. That means that the distribution of force which in the first wearing position 6 ensures a good fit for the headphone on the head is only slightly altered in the second wearing position 6'. As a result the fit of the headphone on the head is scarcely worsened by pivotal movement of the ear cap.

According to the invention the spacing between the pivot axis of the articulation 1 and the central plane 2 of the over-the-head headband is in a range of between 10 mm and 50 mm. That approximately corresponds to half the width of an ear.

Overall therefore in accordance with the invention the headphone is so designed that, due to a pivotal movement of the ear cap into the second operating position, the ear cap remains at the same height on the head so that it is possible to permit a horizontal or symmetrical flow of force between the two ear caps at the ends of the headband.

Optionally the headphone can be of a substantially symmetrical structure so that on both sides, a respective ear cap 6 is fixed to the over-the-head headband 7 pivotably by means of an articulation 1. In that case, in accordance with the first embodiment, each of the ear caps 6 can have a jack into which a connecting cable can be fitted. Thus the connecting cable can be fitted on each side. This means that the user can select the side on which the connecting cable is to be fitted and the side or the ear cap which is then to be freely pivotable. In normal use of the headphone the articulations are respectively disposed laterally above an ear 9*a* of the user 9.

In the case of a symmetrical structure in accordance with the first embodiment with two articulations 1 the articulations 1 can be so designed that the ear caps can be pivoted so that they are at least partially encompassed by the headband (transport position). The headphone can be folded together for example for transport.

FIGS. 3A-3D each show a view on to a headphone according to a second embodiment. The headphone according to the second embodiment can be based on a headphone according to the first embodiment. The headphone according to the second embodiment has a U-shaped or C-shaped headband 7 and at the two ends a respective headband portion 7*b* and at the headband portion 7*b* an articulation 1. The headphone further has two ear caps 6 for accommodating a respective electroacoustic reproduction transducer. The ear caps 6 can be fixed to the articulation 1 by way of a connecting portion or a connecting unit 6*a* so that the ear caps 6 are respectively adapted to be pivotable.

The headband 7 is of a U-shaped or C-shaped configuration and thus spans a central plane 2. The headband portions 7*b* extend out of the central plane 2 so that they are disposed outside the central plane 2. The pivot axes of the articulations 1 are substantially perpendicular to the surface of the head of a user and are thus substantially parallel to the central plane of the headband, but are at a spacing relative to the central plane 2, that is predetermined by the spacer elements 7*b*.

The pivotable ear caps 6 can have various operating positions or wearing positions. In a first position a respective ear cap 6 covers an ear of a user. In such a position a central line 6*b* of the ear cap can be at a first angle relative to the central plane 2 of the headband.

Figure 3A:
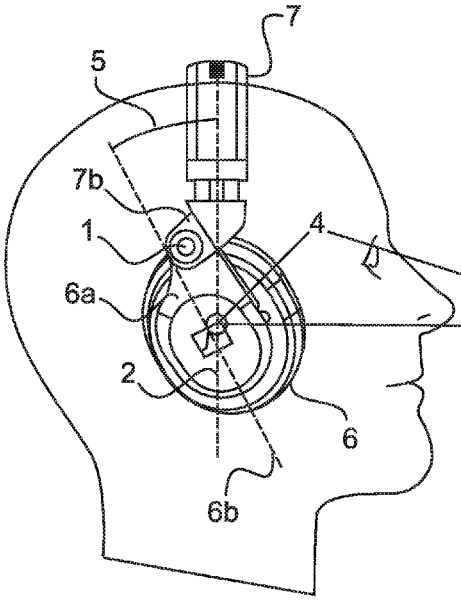
Figure 3B:
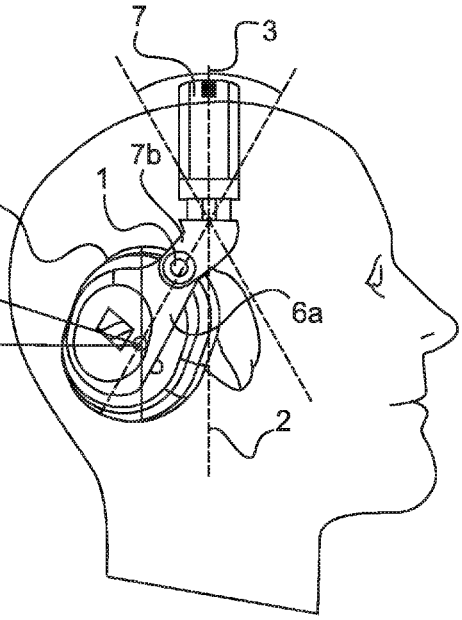

FIG. 3B shows the headphone according to the invention in a second position, that is to say the ear cap 6 has been pivoted from the first position into the second position so that it bears against the head of the user behind the ear. In the second position the central line 6*b* is at a second angle relative to the central plane 2.

Figure 3C:
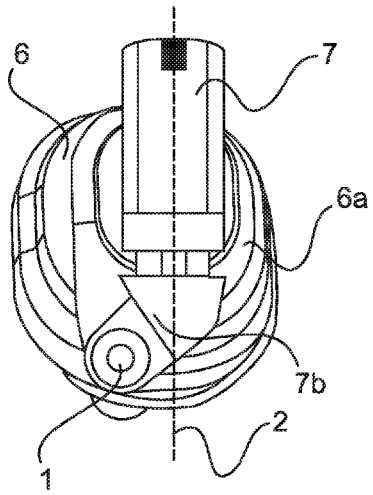

The headphone according to the invention is shown in FIG. 3C in a folded-together condition. This condition corresponds to a transport condition. In this case the ear caps 6 are pivoted in such a way that the headband 7 at least partially surrounds them.

Figure 3D:
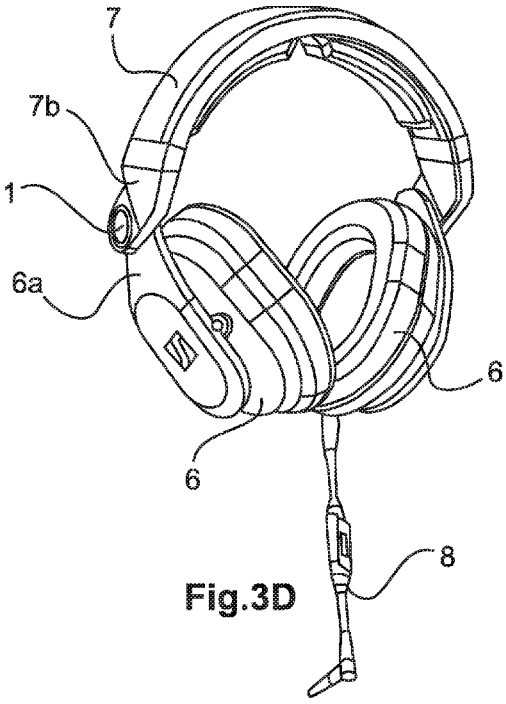

FIG. 3D shows a perspective view of the headphone according to the second embodiment. The headphone has a headband 7 and at the two ends of the headband a headband portion 7*b* which extends out of the plane spanned by the headband. A respective articulation 1 is provided on the headband portions 7*b*. The ear caps 6 can be pivotably coupled to the articulation 1 by way of a connecting unit 6*a*. The ear caps 6 can have a jack for receiving a plug of a cable 8.

In the first wearing position (that is to say when the ear caps are positioned on the ears of the user) then a central point 4 of the ear cap 6 can be on the central plane 2 spanned by the headband 7. According to the second embodiment the pivot axis of the articulation can be arranged perpendicularly to the surface of the head of the user. In the second embodiment the ear caps 6 can be of an oval shape. In the first wearing position a longitudinal axis 6*b* of the ear cap 6 is arranged at a first angle 5 relative to the central plane 2. The ear caps 6 thus extend inclinedly with respect to the headband 7.

In accordance with the second embodiment the central point 4 of the ear cap 6 can bear against the head at the same height in the position of being pivoted away as shown in FIG. 3, as the central point 4 of the ear cap 6 in the normal position as shown in FIG. 3A. It is thus possible to permit a stable fit and at the same time to achieve an agreeable wearing feel. In addition an optimum fit for the headphone on the ear can be guaranteed by the ergonomic inclined positioning of the cap 6.

In the second embodiment the connecting unit 6*a* connecting the articulation 1 to the ear cap 6 does not have a direct contact with the central point 4 of the ear cap 6. According to the invention however in the second embodiment too the notional connecting line between the articulation 1 and the central region 4 of the ear cap 6 is so provided that the central region 4 comes to lie substantially at the same height on the head upon pivotal movement of the ear cap from the first position into the second position.

In accordance with a further embodiment of the invention there is provided a headset instead of a headphone having the above-described features.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A headphone comprising:

an over-the-head headband that has an arcuate configuration and spans a central plane;

a spacer element that is fixedly connected to an end of the over the-head headband and projects out of the central plane;

an articulation that is fixed to the spacer element at a spacing relative to the central plane; and an ear cap that is coupled pivotably, by way of the articulation, to the spacer element;

wherein a pivot axis of the articulation is configured to be perpendicular to a surface of a head of a user of the headphone so that the ear cap can be pivoted by means of the articulation from a first position in which the ear cap covers an ear of the user into a second position in which the ear is exposed;

wherein, when the ear cap is arranged in the first position that covers the ear of the user, a central region of the ear cap is configured to lie within the central plane and is configured to form a connecting line with the articulation that is inclined relative to the central plane spanned by the headband; and wherein the spacing of the articulation from the central plane is such that, in the second position, the central region of the ear cap comes to lie substantially at the same height on the head of the user as in the first position.

2. The headphone as set forth in claim 1;

wherein the ear cap is connected to the articulation by way of a connecting portion.

3. The headphone as set forth in claim 1;

wherein the spacing between the pivot axis of the articulation and the central plane is in a range of between 10 mm and 50 mm.

4. The headphone as set forth in claim 1;

wherein the pivot axis of the articulation is parallel to the central plane.

5. The headphone as set forth in claim 1, further comprising:

a second spacer element that is fixedly connected to a second end of the over the-head headband and projects out of the central plane;

a second articulation that is fixed to the second spacer element at a spacing relative to the central plane; and a second ear cap that is coupled pivotably, by way of the second articulation, to the second spacer element.

6. The headphone as set forth in claim 5;

wherein each of the two ear caps has a jack configured to receive a plug of a connecting cable.

7. The headphone as set forth in claim 5;

wherein the two articulations are configured to enable the two ear caps to be pivoted so that they are at least partially surrounded by the over-the-head headband.

8. A headset comprising:

an over-the-head headband which is of an arcuate configuration and spans a central plane;

a spacer element that is fixedly connected to an end of the over-the-head headband and projects out of the central plane;

an articulation that is fixed to the spacer element at a spacing relative to the central plane; and an ear cap that is coupled pivotably, by way of the one articulation, to the spacer element;

wherein a pivot axis of the articulation is configured to be perpendicular to a surface of a head of a user of the headphone so that the ear cap can be pivoted by means of the articulation from a first position in which the ear cup covers an ear of the user into a second position in which the ear is exposed;

wherein, when the ear cap is arranged in the first position that covers the ear of the user, a central region of the ear cap is configured to lie within the central plane and is configured to form a connecting line with the articulation that is inclined relative to the central plane spanned by the headband; and wherein the spacing of the articulation from the central plane is such that, in the second position, the central region of the ear cap comes to lie substantially at the same height on the head of the user as in the first position.

* * * * *